United States Patent [19]

Carlsson et al.

[11] 4,028,653

[45] June 7, 1977

[54] ELECTRICAL EQUIPMENT HAVING RADIAL COOLING CHANNELS WITH MEANS FOR GUIDING COOLING FLUID THROUGH THE CHANNELS

[75] Inventors: Tage Carlsson; Wolfgang Lampe, both of Ludvika, Sweden

[73] Assignee: ASEA Aktiebolag, Vasteras, Sweden

[22] Filed: Apr. 1, 1976

[21] Appl. No.: 672,718

[52] U.S. Cl. ..... 336/60

[51] Int. Cl.² ..... H01F 27/08

[58] Field of Search ..... 336/55, 60, 185; 310/65

[56] References Cited

UNITED STATES PATENTS

| | | | |
|---|---|---|---|
| 3,391,363 | 7/1968 | Moore | 336/60 X |
| 3,548,354 | 12/1970 | Schwab | 336/60 X |

FOREIGN PATENTS OR APPLICATIONS

| | | | |
|---|---|---|---|
| 1,343,345 | 10/1963 | France | 336/60 |
| 46-15364 | 5/1971 | Japan | 336/60 |
| 456,763 | 7/1968 | Switzerland | 336/60 |

*Primary Examiner*—Thomas J. Kozma
*Attorney, Agent, or Firm*—Watson Cole Grindle & Watson

[57] ABSTRACT

In electrical equipment having windings with radial channels therethrough, which may be formed by spacing coils apart in the axial direction, and which coils are spaced from the inner and outer insulating cylinders, there are provided alternately along the length of the device guide members which have head portions which fill the spaces between the coils and the insulating cylinders and fit against the insulating cylinders, together with downwardly projecting wedge-like tongues which provide spaces of gradual decreasing cross-section, the tongues over-lapping at least two of the passages so that the flowing coolant is distributed between the passages as equally as possible.

3 Claims, 2 Drawing Figures

ELECTRICAL EQUIPMENT HAVING RADIAL COOLING CHANNELS WITH MEANS FOR GUIDING COOLING FLUID THROUGH THE CHANNELS

BACKGROUND OF THE INVENTION

1. Field of the Invention

The present invention relates to a control guide member for controlling the oil flow through the windings of transformers, reactors and similar oil-cooled apparatus.

2. The Prior Art

In transformers the windings are as a rule surrounded by vertical insulating cylinders so that the windings are located in annular axial channels. In these the oil flows upwards past the windings and cools them. If no special measures are taken, the cooling will be very uneven since the outermost burns in a winding disc in the case of disc winding or in a winding layer in the case of layer winding will be much better cooled than the inner layers which are located exactly between the axial cooling channels between the winding and the insulating cylinders.

In order to force the upward oil flow to move also in radial direction through the radial channels between disc and layers, it has been proposed to insert at certain intervals radially directed guide members which extend from the insulating cylinders into the radial channels. The guide members then extend alternately from one and from the other insulating cylinder. By such an arrangement of guide members there is obtained a zig-zag-formed oil flow through the winding from one axial side to the other. To attain a uniform cooling of all discs and layers, however, one guide member for each disc and layer is required. This involves a very long path and a high flow resistance, and also leads to too great a difference in the temperature of the oil between the ends of the winding. Therefore the guide members are placed at considerably greater distances from each other in the axial direction, but this in turn leads to an uneven cooling of the discs and the layer between two guide members, since the radial channel, lying on top of a disc having a control guide member under it, has a very small radial flow of oil and is therefore badly cooled.

SUMMARY OF THE INVENTION

The present invention aims at eliminating the above-mentioned disadvantage by designing the guide member so that a selective control of the oil flow between the various discs and an even cooling of the winding are obtained.

According to the invention, in equipment having windings with radial channels therethrough, which may be formed by spacing coils apart in the axial direction, and which coils are spaced from the inner and outer insulating cylinders, there are provided alternately along the length of the device guide members which have head portions which fill the spaces between the coils and the insulating cylinders and fit against the insulating cylinders, together with downwardly projecting wedge-like tongues which provide spaces of gradual decreasing cross-section, the tongues over-lapping at least two of the passages so that the flowing coolant is distributed between the passages as equally as possible.

Because the guide member has a downwardly-directed wedge-formed tongue, the side of which facing away from the winding makes good contact with the surface of the insulating cylinder facing the winding, the other surface of the tongue, the surface facing the winding, will have a downwardly increasing distance from the winding. This causes the upwardly-directed oil flow between the winding and the insulating cylinder to have an increasing more narrow flow path during its upward movement. The oil flow is therefore forced to move partly in a radial direction in between the discs or the layers in the winding. The length and the shape of the wedge-formed tongue are chosen so that the oil flow will be equal as closely as possible in all axial flow channels.

BRIEF DESCRIPTION OF THE DRAWINGS

The control guide member according to the invention will now be explained with the help of the accompanying drawing, in which.

DESCRIPTION OF THE PREFERRED EMBODIMENTS

Figure 2:
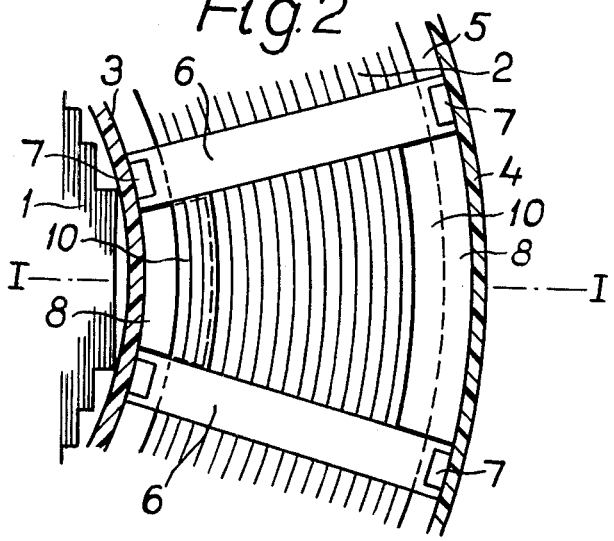
FIG. 2 is a horizontal section along the line II—II in FIG. 1.

In the figures, the core leg is designated 1 and the winding, here shown as a disc winding, is designated 2. An inner insulating cylinder 3 is placed between the core leg and the winding. Outside the winding there is a second insulating cylinder 4. The winding will thus be located in a channel 5 having the shape of a circular ring, in which oil is able to flow upwards for cooling the winding when the transformer is in operation. Between the winding discs there are arranged in a known manner radially directed shoulders 6, shown in FIG. 2. The shoulders are positioned by axial ribs 7, one on either side of the winding.

Figure 1:
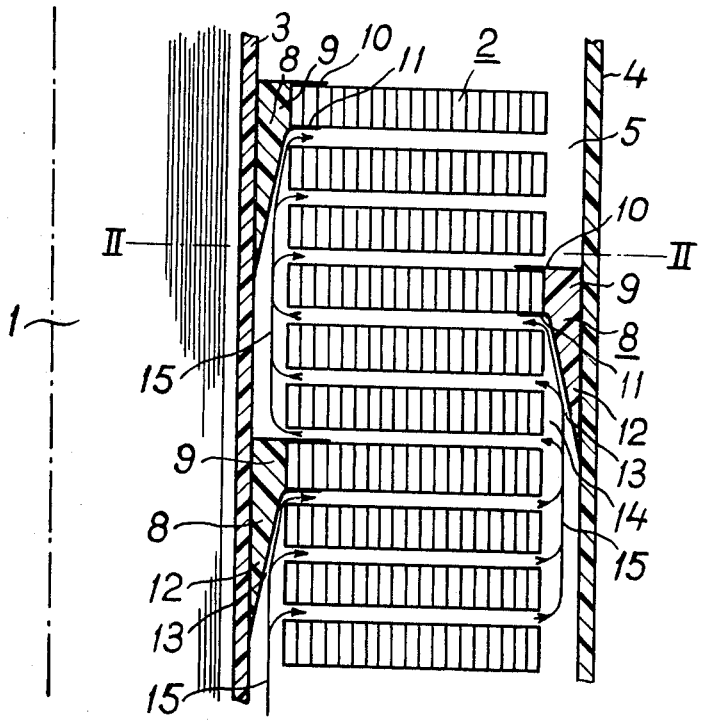
FIG. 1 shows a vertical section in radial direction from the center of a core leg up to and including the outer insulating cylinder of the innermost winding and along the section I—I of FIG. 2.

To control the upwardly-directed oil flow in the cooling channel 5, according to the invention a number of control guide members 8 are arranged alternately on the outside and inside of the winding at different axial heights. Each such guide member consists of a head 9 which fills up the space between a winding disc and a cylinder 4 or 5. The head has two flanges 10, 11, directed towards the winding, said flanges gripping the winding disc, one above and one below the disc. The flanges are arranged and constructed in such a way that they hold the guide member in a safe manner when, during the pressing operation, relative movement takes place between the insulating cylinders and the winding. From the head there also extends a downwardly-directed, wedge-formed portion or tongue 12, the side of which, facing away from the winding, is bent so that it makes good contact with the surface of the cylinder facing the winding, thus preventing oil from passing between the cylinder and the guide member. The surface 13 of the tongue facing the winding is inclined so that its distance from the winding increases in a downward direction, which is clear from FIG. 1. The gap 14 between the surface 13 and the winding 2 will thus diminish in an upward direction, which means that the oil which comes into this gap at the lower end of the control guide member is forced to an increasingly larger extent to pass in between the discs. By varying the length and cross-section of the tongue 12, the shape of the gap 14 can be determined so that as uniform an oil flow as possible is obtained betweeen the different discs. The arrows 15 indicate the flow of the oil in the channel 5 and between the discs.

The downwardly-directed tongue 12 on the control screen results, on the one hand, in an efficient seal against leakage of oil between control guide members and cylinders, and on the other hand in an even and well-defined flow of oil in the radial direction through the winding.

From the above disclosure, it will be clear that the winding is separated from the cylinders by spaces, and that each guide member has an enlarged head which fills the space, with one surface engaging the cylinder, and with a wedge-formed projection extending axially from the head with respect to the cylinder by a distance at least equal to the axial distance between two of the passages, so as to form with the winding a space decreasing in area towards the head, thus distributing the flow of cooling fluid between the passages.

I claim:

1. In electrical equipment having inner and outer insulating cylinders and a winding between the cylinders having a plurality of passages therethrough axially spaced with respect to the cylinders for passage therethrough of a cooling fluid, the winding being separated from one of the cylinders by a space, and a cooling fluid guide member in said space having first and second surfaces and having an enlarged head filling the space, said head including upper and lower flanges engaging a layer of said winding for securing said guide member to the winding, one of said surfaces engaging against the cylinder, and having a wedge-formed projection extending axially from the head with respect to the cylinders by a distance at least equal to the axial distance between two of said passages, said projection having the second surface forming with the winding a space decreasing in area towards the head, whereby the flow of cooling fluid is distributed between such passages.

2. In equipment as claimed in claim 1 having a winding formed of a plurality of layers with support members extending radially thereacross, said guide member extending angularly between two of such support members.

3. In equipment as claimed in claim 1, having both cylinders spaced from the winding, a plurality of such guide members arranged alternately along the winding.

* * * * *